US007700197B2

(12) United States Patent
Akiyama

(10) Patent No.: US 7,700,197 B2
(45) **Date of Patent: *Apr. 20, 2010**

(54) OIL-RESISTANT SHEET MATERIAL

(75) Inventor: Kousuke Akiyama, Sunto-gun (JP)

(73) Assignee: Tokushu Paper Mfg. Co., Ltd., Shizuoka (JP)

( * ) Notice: Subject to any disclaimer, the term of this patent is extended or adjusted under 35 U.S.C. 154(b) by 156 days.

This patent is subject to a terminal disclaimer.

(21) Appl. No.: 11/884,143

(22) PCT Filed: Feb. 9, 2006

(86) PCT No.: PCT/JP2006/302236

§ 371 (c)(1),
(2), (4) Date: Aug. 10, 2007

(87) PCT Pub. No.: WO2006/085572

PCT Pub. Date: Aug. 17, 2006

(65) Prior Publication Data

US 2008/0268240 A1 Oct. 30, 2008

(30) Foreign Application Priority Data

Feb. 10, 2005 (JP) ..... 2005-034320

(51) Int. Cl.
*B32B 27/00* (2006.01)
*B32B 29/00* (2006.01)

(52) U.S. Cl. ..... 428/532; 428/500

(58) Field of Classification Search ..... None
See application file for complete search history.

(56) References Cited

U.S. PATENT DOCUMENTS 5,538,668 A * 7/1996 Hendriks ..... 516/133
2002/0015854 A1* 2/2002 Billmers et al. ..... 428/500

FOREIGN PATENT DOCUMENTS

| | | |
|---|---|---|
| JP | 6-2373 | 1/1994 |
| JP | 06-064324 | 3/1994 |
| JP | 08-209590 | 8/1996 |
| JP | 09-003795 | 1/1997 |
| JP | 09-111693 | 4/1997 |
| JP | 09-211822 | 8/1997 |
| JP | 11-021800 | 1/1999 |
| JP | 2000-026601 | 1/2000 |
| JP | 2000-226794 | 8/2000 |
| JP | 2001-303475 | 10/2001 |
| JP | 2002-069889 | 3/2002 |
| JP | 2004-068180 | 3/2004 |
| JP | 2005-029941 | 2/2005 |
| JP | 2005-029943 | 2/2005 |
| WO | 02/31261 | 4/2002 |

* cited by examiner

*Primary Examiner*—Sheeba Ahmed
(74) *Attorney, Agent, or Firm*—Wenderoth, Lind & Ponack, L.L.P.

(57) ABSTRACT

An oil-resistant sheet material having low resistance to air permeability and being excellent oil resistance, and particularly, being able to be suitably used as a packaging material for food containing edible oil. The oil-resistant sheet material includes at least one coating layer that contains starch and/or polyvinyl alcohol and a fatty acid on at least one side of a substrate in a solid content of 0.5 to 20 g/cm$^2$. When the coating layer further contains a crosslinking agent, the oil resistance is improved. A coating layer that contains a fatty acid as a main component or a coating layer that contains polyvinyl alcohol as a main component may be further applied to the above-mentioned coating layer to form at least two coating layers.

9 Claims, No Drawings

OIL-RESISTANT SHEET MATERIAL

TECHNICAL FIELD

The present invention relates to a sheet material excellent in oil resistance and grease resistance. More specifically, the present invention relates to a sheet material that can be suitably used as a packaging material for food containing edible oil, such as breaded fried food, deep-fried food and the like.

BACKGROUND ART

Conventionally, in order to impart oil resistance to paper, an approach has been taken to make the critical surface tension of a treated surface smaller than the surface tension of an oily substance. Chemicals with such function are called oil-resistant agents, and oil-resistant paper treated with a fluorine containing oil-resistant agent has been mainly used.

For example, as Patent Document 1 presents a fluorine containing oil-resistant agent as a novel oil-resistant agent, those in which a fluorine containing compound such as acrylate or phosphoric ester of perfluorocarbon is used have been mainly used as oil-resistant agents for oil-resistant paper because they are inexpensive and effective.

In the case of oil-resistant paper using a fluorine containing oil-resistant agent, no coating is needed to be formed on the surface of the oil-resistant paper because the oil-resistant agent itself has excellent oil repellency and strong water repellency, and consequently the resistance to air permeability of the oil-resistant paper can be made low.

Recently, however, it has been revealed that when fried food is wrapped with such oil-resistant paper using an oil-resistant agent of a fluorine containing compound and heated up in an electronic oven or the like at a high temperature of 100° C. or higher, harmful gas (fluoroalcohol gas, hydrogen fluoride, etc.) that can be accumulated in the human body is generated, and thus use of the fluorine containing oil-resistant agent has posed a serious problem. It has also been pointed out that even without heating by an electronic oven or the like, similar gas may be generated when such paper is used for packaging a food material having a temperature of 100° C. or higher.

In addition, fluorine containing organic compounds have extremely poor biodegradability and there is a global concern for pollution due to these substances. As a reflection of such danger to human health and impact on the global environment as described above, the use of fluorine containing compounds has posed serious social problems.

Patent Document 2 proposes an oil-resistant paper container made of an oil-resistant paper prepared without using any fluorine containing compound, but prepared by forming on the surface of the paper a barrier layer containing crosslinked polyvinyl alcohol and/or starch and a water resistant additive as main components and by applying to the barrier layer a silicone resin and an adhesive for heat sealing. However, this oil-resistant paper container does not always have satisfactory oil resistance, and further involves a problem such that the production cost of the container is high because silicone resin is expensive.

Patent Document 3 proposes an oil-resistant paper prepared by applying a coating layer containing nonionic or cationic polyvinyl alcohol and a coating layer containing a fluorine containing oil-resistant agent in this order. However, the coating layer of polyvinyl alcohol used in this case has a role of preventing permeation of the fluorine containing oil-resistant agent into paper, which is quite different from the subject matter of the present invention.

Patent Document 4, Patent Document 5 and Patent Document 6 propose oil-resistant paper using acrylic emulsion as an oil-resistant agent. However, these kinds of oil-resistant paper proposed in these Patent Documents require a thick acrylic resin coating for satisfying desired oil resistance, resulting in an extremely high resistance to air permeability so as to impair the properties as a food packaging material. When a food packaging material has a high resistance to air permeability and food is heated or kept warm while being wrapped with the packaging material, the inside of the package is filled with vapor generated from food, and food is moistened with condensed dew, and texture and taste of the food are remarkably degraded as the case may be. In addition, when the food is reheated in an electronic oven or the like while being wrapped with the packaging material, rapidly generated vapor cannot be discharged to the outside and the package may be broken. Moreover, in order to form a coating having sufficient oil resistance, a large coating amount is needed, and consequently a problem of increased costs of packaging materials is caused.

When food is heated in an electronic oven or the like while being wrapped with a packaging material, the easiness in discharging of the vapor generated therein to the outside may be represented by the vapor permeability as well as the resistance to air permeability. As a method for measuring the vapor permeability, there is a method referred to as "the moisture permeability measurement method for moisture-proof packaging material" specified in JIS Z-0208 (1976), wherein the moisture permeability is defined as "the amount of the vapor passing through a unit area of a film material in a specified time." However, this measurement method takes very long time, and is not suitable as a method expected to be compatible even with the cases involving such problems at the time of actually being used as food packaging materials that vapor is condensed as dew in the package, and the rapidly generated vapor cannot be discharged to the outside and the package is broken while food is heated in an electronic oven. Accordingly, as an evaluation test of the moisture permeability of such food packaging material as the present invention, it is preferable to examine the dew condensation conditions in a package and the package break conditions as observed by actually placing and heating food or a substitute therefor in the package.

On the other hand, in order to ensure high oil resistance, lamination of film on the surface of paper has been generally practiced. However, when a film is laminated, the resistance to air permeability becomes extremely high, and the resulting food packaging material is defective as described above.

To prevent the resistance to air permeability from becoming extremely high, Patent Document 7 proposes an air-permeable oil-resistant sheet including a substrate such as a sheet of paper having pores and a thermoplastic film having pores similar to those of the substrate and being laminated on at least one side of the substrate. It is also proposed to form a laminate of non-woven fabric and paper. However, there has been a problem that such sheets cannot fully prevent edible oil from bleeding to the outside, and excellent oil resistance has not been achieved.

Patent Document 8 proposes an oil-resistant paper using hydrophobized starch. However, for the purpose of achieving sufficient oil resistance by using only hydrophobized starch, an enormous amount of hydrophobized starch is required to be applied, and this is impractical in terms of the cost. In addition, increase in resistance to air permeability due to the increased coating amount also causes a problem. Further, when oil-resistant paper using hydrophobized starch alone is used as a food packaging material, there has been a problem that the starch is dissolved due to vapor generated from the food being heated and adheres to the surface of the food because the starch is easily soluble in water.

Patent Document 9 proposes oil-resistant paper coated with an oil-resistant agent in which polyvinyl alcohol is used or polyvinyl alcohol and a crosslinking agent are used in combination. A small coating amount of this oil-resistant agent can attain a high oil resistance, and hence the resistance to air permeability is suppressed to be lower as compared to other oil-resistant agents containing no fluorine; however, this oil-resistant agent includes polyvinyl alcohol, and hence the suppression cannot be said to be sufficient. Further, application of this oil-resistant agent with a size press causes a problem of staining of the dryer.

Patent Document 10 proposes oil-resistant paper prepared by making non-sized paper uniformly contain starch, polyvinyl alcohol and an acrylic oil-resistant agent. However, this oil-resistant paper is also insufficient in oil resistance as a food packaging material, and accordingly, in order to ensure sufficient oil resistance, a large amount of coating layer is needed to be formed, resulting in a problem that the resistance to air permeability is increased.

Patent Document 11 proposes oil-resistant paper having on a paper substrate two coating layers, namely, a lower layer that is a coating layer composed of a mixture of an elastomer such as rubber latex or a water-retaining/water-absorbing polymer and a gelatinizable starch and an upper layer that is a coating layer composed of a starch decreased in viscosity or a starch derivative. This oil-resistant paper ensures the oil resistance mainly on the basis of starch and elastomer or a water-retaining/water-absorbing polymer, and hence, in order to ensure sufficient oil resistance, resistance to air permeability is forced to be sacrificed; consequently, no oil-resistant sheet material excellent in oil resistance and low in resistance to air permeability has been able to be obtained. Additionally, in this oil-resistant treated paper, the starch is used for the purpose of forming a film, and the resistance to air permeability is out of the scope of consideration.

As described above, the conventional art has never been able to obtain any oil-resistant paper that can simultaneously satisfy desired oil resistance, resistance to air permeability and productivity so as to be suitable as a food packaging material.

[Patent Document 1]: Japanese Patent Laid Open No. 12-026601

[Patent Document 2]: Japanese Patent Publication No. 6-2373

[Patent Document 3]: Japanese Patent Laid Open No. 8-209590

[Patent Document 4]: Japanese Patent Laid Open No. 9-3795

[Patent Document 5]: Japanese Patent Laid Open No. 9-111693

[Patent Document 6]: Japanese Patent Laid Open No. 2001-303475

[Patent Document 7]: Japanese Patent Laid Open No. 11-021800

[Patent Document 8]: Japanese Patent Laid Open No. 2002-69889

[Patent Document 9]: Japanese Patent Laid Open No. 2004-68180

[Patent Document 10]: Japanese Patent Laid Open No. 2005-29943

[Patent Document 11]: Japanese Patent Laid Open No. 2005-29941

DISCLOSURE OF THE INVENTION

An object of the present invention is to solve the problem of safety to humans and environment caused by the use of conventional oil-resistant paper, as a food packaging material, that uses fluorine containing oil-resistant agents and the problems related to the high resistance to air permeability and high cost of oil-resistant paper, as food packaging material, that uses oil-resistant agents containing no fluorine. More specifically, an object of the present invention is to provide an oil-resistant sheet material having low resistance to air permeability, and being harmless to humans and excellent in oil resistance and in productivity.

The invention of claim 1 of the present application is an oil-resistant sheet material characterized in that at least one coating layer containing starch and/or polyvinyl alcohol and a fatty acid is formed on at least one side of a substrate in a solid content of 0.5 to 20 $g/m^2$.

The invention of claim 2 of the present application is the oil-resistant sheet material according to claim 1, wherein the coating layer further contains a crosslinking agent.

The invention of claim 3 of the present application is the oil-resistant sheet material according to claim 1 or 2, wherein at least one coating layer containing polyvinyl alcohol as a main component is further formed.

The invention of claim 4 of the present application is the oil-resistant sheet material according to claim 1 or 2, wherein at least one coating layer containing a fatty acid as a main component is further formed.

The invention of claim 5 of the present application is an oil-resistant sheet material characterized in that at least two coating layers comprising the coating layer as defined in claim 1 or 2 disposed closer to the substrate and the coating layer, as defined in claim 4, containing a fatty acid as a main component disposed farther from the substrate are formed on at least one side of the substrate.

The invention of claim 6 of the present application is the oil-resistant sheet material according to any one of claims 2 to 5, wherein the crosslinking agent is an epichlorohydrin crosslinking agent.

The invention of claim 7 of the present application is the oil-resistant sheet material according to any one of claims 1 to 6, wherein the fatty acid is a fatty acid sizing agent.

The invention of claim 8 of the present application is the oil-resistant sheet material according to any one of claims 1 to 7, wherein the fatty acid is modified with epichlorohydrin.

The invention of claim 9 of the present application is the oil-resistant sheet material according to any one of claims 1 to 8, wherein the resistance to air permeability specified in JIS P-8117 is 10000 seconds or less.

According to the present invention, an oil-resistant sheet material having low resistance to air permeability, harmless to humans, and being excellent in oil resistance and in productivity can be obtained. The oil-resistant sheet material of the present invention can be particularly suitably used as a packaging material for food containing edible oil.

BEST MODE FOR CARRYING OUT THE INVENTION

It is essential that a coating layer in the present invention contains starch and/or polyvinyl alcohol and a fatty acid. The present inventor has verified that by including starch and/or polyvinyl alcohol and a fatty acid in the coating layer, the oil resistance is drastically improved to such an extent that cannot be expected when each of them is used alone. The oil resistance as referred to herein means the capability of blocking oil permeation. In general, the oil resistance, namely, the capability of blocking oil permeation is evaluated by measuring the permeation time of oils such as castor oil. Here, the oil permeation time is measured as the time in which a drop of oil placed on the surface of a sample in an environment of 23° C. and 50% R.H. perfectly permeates the sample to reach the reverse side thereof. Perfect permeation means the condition that the surface area with the drop of oil placed thereon is transferred to the reverse side without any change of the area, and such condition is visually checked. The oil-resistant sheet material as referred to in the present invention means such paper that has a castor oil permeation time of 0.5 hour or more.

Examples of the starch usable in the present invention include, in addition to common starch, grafted starch, hydroxypropyl starch, carboxymethyl starch, cationic starch, starch acetate, starch phosphate, distarch phosphate, glycerol distarch, white dextrin, yellow dextrin, British gum, maltodextrin, starch oxide, alpha starch, crosslinked starch, roasted starch and enzyme-modified starch. Further, granular starch prepared by granulation, porous oil-absorbing starch and the like can be preferably used.

As polyvinyl alcohol, either completely saponified or partially saponified polyvinyl alcohol can be used. Polyvinyl alcohol may be modified with a carboxyl group, a cyanol group or the like. From the viewpoint of oil resistance, polyvinyl alcohol modified with a carboxyl group or a cyanol group is preferably used. In view of the balance between the oil resistance, resistance to air permeability and packaging adaptability, polyvinyl alcohol preferably has a saponification degree of 85 to 100% and an average polymerization degree of 300 to 2500.

The fatty acid used in the present invention may contain a fatty acid component as a main component, and may be a modified fatty acid or a fatty acid salt. In other words, those substances which do not include a fatty acid as a main component are not included. The main component as referred to herein means that the fatty acid accounts for 50% by weight or more of the constituent substances. For example, a fatty acid amide derived from a fatty acid and a fatty acid ester produced from a fatty acid and alcohol may also preferably be used. Examples of a fatty acid may include saturated fatty acids, unsaturated fatty acids, distilled fatty acids and hydrogenated fatty acids. These fatty acids are preferably emulsified or saponified so as to be applicable to coating, but they need not be emulsified or saponified as long as they can be coated, for example, after heating and melting. In addition, vegetable fatty acids and animal fatty acids may also be used.

The fatty acid modified into cations has hitherto been widely used as a fatty acid sizing agent for papermaking. Such a fatty acid sizing agent can also be used in the present invention as a fatty acid. Examples of such fatty acid sizing agents include those in which a cationic fixing agent such as polyamine is added to a fatty acid, a fatty acid salt and a fatty acid modified to be imparted with functionalities, and further include a fatty acid modified with epichlorohydrin. In general, the fatty acid sizing agents include those obtained by condensation between a fatty acid and polyamine and by reaction between alkenylsuccinic acid and polyamine. A condensate between a fatty acid and polyamine may be preferably used as a quaternary salt modified with epichlorohydrin. Preferable as a fatty acid are higher aliphatic monocarboxylic or polycarboxylic acids having 8 to 30 carbon atoms, and particularly preferable among these are those having 12 to 25 carbon atoms. Examples of the aliphatic carboxylic acids include stearic acid, oleic acid, lauric acid, palmitic acid, arachic acid, behenic acid, tall oil fatty acid, alkylsuccinic acid and alkenylsuccinic acid. Examples of the polyamine include polyalkylene polyamine, diethylenetriamine, triethylenetetramine, tetraethylenepentamine, pentaethylenehexamine, dipropylenetriamine, tripropylenetetramine and aminoethylethanolamine. In addition to the above descried, examples to be usable as the sizing agent using a fatty acid include fatty acid amides such as stearylamide; and fatty acid amide waxes such as N-substituted fatty acid amides including N,N'-ethylenebisstearylamide. Also in this case, the fatty acid preferably has 8 to 30 carbon atoms. Additionally, fatty acid chromium complexes can also be used. As the fatty acid used in the present invention, any of those sizing agents which use the above described fatty acids can be preferably used.

The use of a fatty acid sizing agent for papermaking as an internally added sizing agent has hitherto been known to improve the oil resistance of paper. However, the oil resistance as referred to herein means such degree of oil resistance that prevents the ink strike-through when the paper is used for offset printing, and hence this oil resistance is markedly lower than the oil resistance required for the food packaging material as referred to in the present invention. Thus, the use of a fatty acid sizing agent for oil-resistant paper used as food packaging material or the like has never been studied.

Moreover, a fatty acid sizing agent for papermaking is generally used as an internally added sizing agent to improve the Stockigt sizing degree of paper; however, the addition of the fatty acid sizing agent to a coating solution for forming a coating layer that is intended to improve the oil resistance has never been studied.

The fatty acid used in the present invention has a melting point of preferably 20° C. or higher, more preferably 40° C. or higher. When the coating layer containing a fatty acid having a melting point of lower than 20° C. is applied to the substrate to form a sheet material, the sheet material becomes oily and difficult to handle. When the sheet material containing a fatty acid having a melting point of lower than 40° C. is used as a food packaging material, there is a possibility that the fatty acid is melted during heating food or during keeping food warm, and the oil resistance is thereby degraded as the case may be.

Preferably, by using a fatty acid modified with epichlorohydrin as the fatty acid used in the present invention, the oil resistance of the sheet material can be drastically improved as compared to the case where a fatty acid is used without modification. Here, the modification with epichlorohydrin not only means simple introduction of an epichlorohydrin group into a fatty acid but include the cases where epichlorohydrin is added to a fatty acid in some way including the use of epichlorohydrin as a dispersant for the fatty acid.

A fatty acid is added to starch and/or polyvinyl alcohol in a solid content of preferably 1 to 30% by weight, more preferably 3 to 15% by weight based on the total weight of the solid content of the starch and/or polyvinyl alcohol. When the proportion is less than 1% by weight, no sufficient oil resistance is attained as the case may be. When the proportion is more than 30% by weight, the oil resistance is not improved in proportion to the amount added, to be disadvantageous in terms of the cost, and additionally, the proportion of the fatty acid is too large, so that the proportion of the starch and/or polyvinyl alcohol in the coating layer is decreased, and consequently, the oil resistance of the sheet material is unpreferably decreased. In addition, a sheet material obtained by applying to the substrate a coating layer to which a fatty acid is added tends to be slippery, but when 15% by weight or less of a fatty acid is added to the coating layer, preferably the sheet material becomes less slippery to be easier to handle. When 3% by weight or less of a fatty acid is added, the oil resistance becomes insufficient depending on the types of oil as the case may be.

When the coating layer contains a fatty acid, the oil resistance is improved, but the principle underlying this improvement is not clear. In this connection, the present inventor assumes that the fatty acid absorbs the oil permeating the sheet to block the permeation of the oil. Additionally, because the coating layer containing only a fatty acid cannot ensure the oil resistance, the present inventor assumes that the oil resistance is improved owing to some action or reaction brought about by the combination of starch and/or polyvinyl alcohol with the fatty acid.

When a fatty acid is mixed with starch and/or polyvinyl alcohol to form a coating layer, the fatty acid has an effect to decrease the resistance to air permeability through preventing starch and/or polyvinyl alcohol from forming coating, in addition to the oil resistance improvement effect; thus, although the resistance to air permeability is decreased, the oil resistance is not decreased, and can even be improved. Such features are extremely effective for food packaging materials, required to maintain low resistance to air permeability and to have high oil resistance, such as food packaging materials to be used in an electronic oven and packaging materials for food material containing much moisture.

When the coating layer contains a fatty acid, the fatty acid serves as a release agent and can thereby attain an effect to prevent the dryer from being stained when the coating layer is formed by size-press coating. In other words, addition of a fatty acid to the coating layer improves the oil resistance of the obtained sheet material and at the same time brings about an effect to prevent the dryer from being stained, when the coating layer is formed by size-press coating, so as to improve the productivity. Further, since the fatty acid serves as a release agent, when the oil-resistant sheet material according to the present invention is used as a packaging material of fried food such as fried chicken, the releasing properties between the food material and the packaging material are improved, and the adhesion of the skin of fried chicken to the packaging material can be effectively prevented.

In the present invention, the configuration in which a coating layer containing starch and/or polyvinyl alcohol and a fatty acid is formed may include a configuration in which a coating layer containing a mixture of starch and/or polyvinyl alcohol and a fatty acid is formed, and a configuration in which a coating layer containing starch and/or polyvinyl alcohol and a coating layer containing a fatty acid are formed separately. In other words, in the present invention, as long as the coating layer contains starch and/or polyvinyl alcohol and a fatty acid, these components may be applied as a mixture, or may be applied as separate layers. Needless to say, the coating materials to be applied to form the coating layers may be added with other components commonly used as raw materials for coating materials.

The coating layer containing starch and/or polyvinyl alcohol and a fatty acid is needed to be formed on at least one side of the substrate in a solid content of 0.5 to 20 g/m$^2$. When the solid content is less than 0.5 g/m$^2$, no sufficient oil resistance can be ensured. When the solid content is more than 20 g/m$^2$, the oil resistance is not increased in proportion to the coating amount, to be disadvantageous in terms of the cost, and additionally, to cause a problem that the resistance to air permeability is increased and the package thereby tends to be broken. For coating, size-press coating is advantageous in terms of the cost and is accordingly preferable; in size-press coating, the coating amount is preferably 0.5 to 7 g/m$^2$. When the coating amount is more than 7 g/m$^2$, unpreferably the dryer is possibly stained at the time of drying. Such coating layer may be formed on both sides of the substrate according to need, and in that case, the coating amount is preferably regulated in such a way that the total coating amount of the coating layers on both sides is set to fall within the above-described coating amount range.

In the present invention, by adding a crosslinking agent to the coating layer containing starch and/or polyvinyl alcohol and a fatty acid, the oil resistance can be further improved. The reason for this improvement is not clear. However, because no oil resistance of the sheet material is attained by applying only a crosslinking agent to the substrate, it is assumed that some action exerted by the components such as the fatty acid, starch and/or polyvinyl alcohol and the crosslinking agent improves the oil resistance of the sheet material.

The crosslinking agent used in the present invention is not particularly limited as long as it is capable of crosslinking starch and/or polyvinyl alcohol. Examples of the crosslinking agent include glyoxal, dialdehyde, polyacrolein, N-methylolurea, N-methylolmelamine, activated vinyl compounds, various esters, diisocyanate and urethane crosslinking agents. In view of economic efficiency, reaction stability and effects on food, epoxy compounds such as epichlorohydrin are preferably used.

The crosslinking agent is added to starch and/or polyvinyl alcohol in a solid content of preferably 1 to 30% by weight, more preferably 5 to 15% by weight based on the total weight of the solid contents of starch and/or polyvinyl alcohol. When the proportion is less than 1% by weight, no sufficient effect is attained, and when the proportion is more than 30% by weight, unpreferably no effect is attained in proportion to the amount added, to be disadvantageous in terms of the cost. When the amount of the crosslinking agent added is too large, the proportion of starch and/or polyvinyl alcohol based on the total coating amount is small, and unpreferably the oil resistance is thereby degraded.

When a fatty acid modified with epichlorohydrin is used as the fatty acid added to starch, the coating material agglomerates to generate an agglomerate as the case may be. When the agglomerate is generated, although the oil resistance is not affected, the agglomerate unpreferably stains the paper machine and the coating machine as the case may be. Further, when the obtained sheet material is used as a food packaging material, there is a fear of adhering of the agglomerate to food. For this reason, when a fatty acid modified with epichlorohydrin is used with starch, it is preferable to add polyvinyl alcohol to the coating material in order to suppress the agglomerate generation due to the agglomeration of the coating material.

When polyvinyl alcohol is added in order to suppress the agglomeration of the coating material, the polyvinyl alcohol is added in a proportion of preferably 10% by weight or more, more preferably 20% by weight or more based on the weight of the fatty acid. When the proportion is less than 10% by weight, the effect of suppressing agglomeration is not sufficient as the case may be. On the other hand, when the proportion is more than 20% by weight, the effect of the addition of polyvinyl alcohol is unpreferably leveled off.

Even with a coating layer containing only polyvinyl alcohol and a fatty acid, namely, without using starch, the oil-resistant sheet material of the present invention can be obtained. In general, polyvinyl alcohol is more expensive than starch and higher in coating formability, and hence tends to give higher resistance to air permeability as compared to starch. On the other hand, polyvinyl alcohol is superior in oil resistance to starch, and hence polyvinyl alcohol and starch can be used each alone or a mixture thereof according to the intended application. By regulating the mixing ratio between starch and polyvinyl alcohol, the oil resistance and the resistance to air permeability suitable for the intended application can be obtained.

The present invention permits lamination of two or more coating layers on one side or both sides of the substrate. In this case, the following two embodiments may be possible: (1) an embodiment in which a coating layer containing starch and/or polyvinyl alcohol and a fatty acid, and a coating layer containing a fatty acid as a main component or a coating layer containing polyvinyl alcohol as a main component are laminated; and (2) another embodiment in which a coating layer containing starch and/or polyvinyl alcohol, a fatty acid and a crosslinking agent, and a coating layer containing a fatty acid as a main component or a coating layer containing polyvinyl alcohol as a main component are laminated. Additionally, yet another embodiment is possible in which, as described above, in place of the coating layer containing starch and/or polyvinyl alcohol and a fatty acid, the coating layers respectively containing these components are laminated; in this case, when a crosslinking agent is added, the crosslinking agent may be added to any one of these layers.

The coating layer containing a fatty acid as a main component specifically means that the coating layer contains 50% by weight or more of the fatty acid based on the weight of the solid content of the coating layer. In this case, the components other than the fatty acid include commonly used coating materials for paper such as a surface sizing agent which affects the impregnation of a coating solution and a surface strength agent for preventing paper dust, in addition to the above-described starch, polyvinyl alcohol and crosslinking agent. These components may be contained in the coating layer containing a fatty acid as a main component within the ranges that do not impair the properties of the oil-resistant sheet material.

The coating layer containing polyvinyl alcohol as a main component specifically means that the coating layer contains 50% by weight or more of polyvinyl alcohol based on the weight of the solid content of the coating layer. In this case, components other than polyvinyl alcohol include commonly used coating materials for paper such as a surface sizing agent which affects the impregnation of a coating solution and a surface strength agent for preventing paper dust, in addition to the above-described starch, fatty acid and crosslinking agent. These components may be contained in the coating layer containing polyvinyl alcohol as a main component within the ranges that do not impair the properties of the oil-resistant sheet material.

When the coating layer containing starch and/or polyvinyl alcohol and a fatty acid and the coating layer containing a fatty acid as a main component are formed separately, excellent oil resistance can be imparted to the sheet material through the synergistic effect of these two coating layers. In addition, by separately forming the coating layer containing a fatty acid as a main component, a sheet material having extremely low resistance to air permeability and being excellent in oil resistance can be obtained. Further, when the coating layer containing polyvinyl alcohol as a main component is separately formed, as compared to the case where the coating layer containing a fatty acid as a main component is formed, the sheet material tends to have a higher resistance to air permeability, but has a better oil resistance. As herein described, by forming the coating layer so as to be composed of two separate coating layers, an appropriate balance can be established between the resistance to air permeability and the oil resistance. Thus, by forming the above-described various coating layers each alone or in combination, an oil-resistant sheet material with properties suitable for the intended applications can be obtained.

In the embodiment in which the coating layer containing a fatty acid as a main component is separately formed, the coating layer containing a fatty acid as a main component is preferably formed at a position farther from the substrate than the coating layer containing starch and/or polyvinyl alcohol and a fatty acid or the coating layer containing starch and/or polyvinyl alcohol, a fatty acid and a crosslinking agent. In this way, the oil resistance of the sheet material can be further increased. In addition, by forming the coating layer containing a fatty acid as a main component so as to be exposed on the surface of the sheet material, when the sheet material is used as a food packaging material, preferably the material also has an effect of preventing adhesion of the skin of fried chicken and the like to the packaging material.

In the embodiment in which the coating layer containing polyvinyl alcohol as a main component is separately formed, the coating layer may be formed so as to be closer to or farther from the substrate, or as the outermost layer. When the coating layer containing polyvinyl alcohol as a main component is formed so as to be closer to the substrate, the layer serves to prevent the permeation of a coating solution into the substrate so as to increase the resistance to air permeability of the sheet material as the case may be, but the oil resistance is increased. On the other hand, when the coating layer containing polyvinyl alcohol as a main component is formed so as to be farther from the substrate, the resistance to air permeability is low, but the oil resistance is low as the case may be. In addition, when the coating layer containing polyvinyl alcohol as a main component is formed as an outermost layer, the above-described slipperiness due to a fatty acid can be reduced.

Taking the above-described characteristics into consideration, the position of the coating layer containing a fatty acid as a main component or the coating layer containing polyvinyl alcohol as a main component may be determined according to the intended application of the oil-resistant sheet material.

In the above described embodiments in which two or more coating layers are laminated, the fatty acid and polyvinyl alcohol that can be used in the coating layer containing a fatty acid as a main component and in the coating layer containing polyvinyl alcohol as a main component may be the same as the fatty acid and polyvinyl alcohol that can be used in the coating layer containing starch and/or polyvinyl alcohol and a fatty acid.

In addition, for the purpose of further imparting particular properties such as heat sealing properties and releasing properties to the oil-resistant sheet material according to the present invention, a layer of heat sealing agent, a layer of a release agent or other layers suitable for required properties may be additionally formed.

In the present invention, conventional chemicals for papermaking may be added to the coating layer within the ranges that do not impair the properties of the oil-resistant sheet material. For example, a surface sizing agent, a dryer release agent, an antifoaming agent, a surface strength agent or an antistatic agent may be added to the coating layer according to the intended applications of the oil-resistant sheet material.

In the present invention, the substrate on which the coating layer is formed is not particularly limited, but from the viewpoint of the resistance to air permeability, a sheet material including fiber as a main component is preferred. Examples of the fiber used for the substrate include vegetable fibers such as wood pulp and non-wood pulp; synthetic pulp; synthetic fiber; and inorganic fiber; these may be used each alone or in an appropriate combination.

When the paper prepared by using papermaking pulp as vegetable fiber is used as the substrate, the beating degree of the pulp is preferably 100 to 500 ml in Canadian Standard Freeness. When the beating degree is lower than 100 ml, unpreferably the drainage on machine wire becomes poor, when manufacturing paper, to remarkably decrease the production efficiency, and the density of paper becomes excessively high so as to make the resistance to air permeability tend to be high. When the beating degree is 500 ml or more, unpreferably no sufficient oil resistance is obtained as the case may be.

As an auxiliary substance for papermaking, commonly used auxiliary substances for papermaking may be used. In particular, when guar gum, a fatty acid, a water resistant additive or aluminum sulfate is used as an internal additive, the oil resistance of paper itself is improved, and when combined with the coating layer of the present invention, preferably excellent oil resistance can be achieved.

Examples of the method usable for forming the coating layer on the substrate in the present invention may include: various coaters such as a size-press coater, a gate roll coater, a billblade coater, a rod-metering coater, a blade-metering coater, an air knife coater, a roll coater, a reverse roll coater, a bar coater, a rod coater, a blade coater, a curtain coater, a gravure coater, a die slot coater and a short dwell coater; a dipping machine; and various printing machines. From the viewpoint of the cost-related advantage, an on-machine apparatus is preferably used.

In the present invention, the coating layer containing the pre-determined components is formed on the substrate, and in addition, starch may be contained also in the substrate itself, and thus the oil resistance of the sheet material can be further improved. In this case, the content of the starch is preferably 1 to 15% by weight based on the total weight of the substrate. When the content is less than 1% by weight, no sufficient effect is attained as the case may be. Even when starch is contained in a content of more than 15% by weight, the oil resistance is not improved to be disadvantageous in terms of the cost. When a paper substrate is adopted, a papermaking raw material containing an excessively large amount of starch, which is a hydrophilic component, degrades the drainage in papermaking process to significantly degrade the productivity.

The oil-resistant sheet material of the present invention preferably has a resistance to air permeability of 10000 seconds or less. The resistance to air permeability as referred to herein means a measured value of the air permeance of a sheet of paper as specified in JIS P-8117. When the oil-resistant sheet material has a resistance to air permeability exceeding 10000 seconds and is used as a food packaging material, as described above, heating food or keeping food warm while being wrapped with the packaging material leads to such results that the inside of the package is filled with vapor generated from food, and the food is moistened with condensed dew, and texture and taste of the food are remarkably degraded as the case may be. In addition, when food is heated in an electronic oven or the like while being wrapped with the packaging material, there is a danger that rapidly generated vapor cannot be discharged to the outside and the package may be broken.

EXAMPLES

Example 1

A raw material pulp slurry was prepared as follows: 50% by weight of hardwood bleached kraft pulp produced from an aspen material and 50% by weight of softwood bleached kraft pulp were used as wood pulp and beaten to a beating degree of 350 ml in Canadian Standard Freeness with a double disk refiner to prepare the above-mentioned slurry. A raw material slurry was prepared by adding, to the raw material pulp slurry, an epichlorohydrin wet strength agent in a solid content concentration of 0.5% by weight based on the weight of the pulp, a rosin sizing agent in a solid content concentration of 0.5% by weight based on the weight of the pulp and aluminum sulfate in a proportion of 4% by weight based on the weight of the pulp. The raw material slurry was subjected to papermaking to prepare a paper substrate so as to have a basis weight of 42 g/m$^2$, using a Fourdrinier paper machine.

A coating solution was prepared by adding starch oxide and a fatty acid sizing agent (main component: palmitic acid; melting point: 63 to 64° C.), cationized with polyamine and modified with epichlorohydrin, in a solid content concentration of 5% by weight based on the weight of the starch oxide. An oil-resistant sheet material having a basis weight of 45 g/m$^2$ was prepared by applying the coating solution to both sides of the paper substrate prepared above in such a way that the total amount of the coating layers formed on both sides with this coating solution was 3.0 g/m$^2$.

Example 2

An oil-resistant sheet material having a basis weight of 45 g/m$^2$ was prepared in the same manner as in Example 1 except that carboxyl-modified polyvinyl alcohol having a saponification degree of 93 to 95% and a polymerization degree of 2000 was used in place of starch oxide.

Example 3

An oil-resistant sheet material having a basis weight of 45 g/m$^2$ was prepared in the same manner as in Example 1 except that a polyamide-epichlorohydrin resin was added as a crosslinking agent to the coating solution in a solid content concentration of 10% by weight based on the weight of the starch oxide.

Example 4

An oil-resistant sheet material having a basis weight of 45 g/m$^2$ was prepared in the same manner as in Example 3 except that carboxyl-modified polyvinyl alcohol having a saponification degree of 93 to 95% and a polymerization degree of 2000 was used in place of starch oxide.

Example 5

An oil-resistant sheet material having a basis weight of 45 g/m$^2$ was prepared in the same manner as in Example 3 except that carboxyl-modified polyvinyl alcohol having a saponification degree of 93 to 95% and a polymerization degree of 2000 was added to the coating solution in a proportion of 300% by weight based on the weight of the fatty acid sizing agent.

Example 6

An oil-resistant sheet material having a basis weight of 45 g/m$^2$ was prepared by applying, to the paper substrate prepared in Example 1, the coating solution prepared in Example 3 in such a way that the total amount of the coating layers on both sides was 2.5 g/m$^2$, and by further applying, to these coating layers, a coating solution containing only a fatty acid sizing agent (main component: palmitic acid; melting point: 63 to 64° C.) cationized with polyamine and modified with epichlorohydrin in such a way that the total amount of the coating layers on both sides was 0.5 g/m$^2$.

Example 7

An oil-resistant sheet material having a basis weight of 45 g/m$^2$ was prepared by applying, to the paper substrate prepared in Example 1, a coating solution containing only starch oxide in such a way that the total amount of the coating layers on both sides of the sheet was 2.5 g/m$^2$, and by further applying, to these coating layers, a coating solution containing only a fatty acid sizing agent (main component: palmitic acid; melting point: 63 to 64° C.) cationized with polyamine and modified with epichlorohydrin in such a way that the total amount of the coating layers on both sides was 0.5 g/m$^2$.

Example 8

An oil-resistant sheet material having a basis weight of 45 g/m$^2$ was prepared in the same manner as in Example 7 except that a coating solution containing only carboxyl-modified polyvinyl alcohol having a saponification degree of 93 to 95% and a polymerization degree of 2000 was used in place of the coating solution containing only starch oxide.

Example 9

An oil-resistant sheet material having a basis weight of 45 g/m$^2$ was prepared by applying, to the paper substrate prepared in Example 1, a coating solution prepared so as to contain starch oxide and a polyamide-epichlorohydrin resin as a crosslinking agent in a solid content concentration of 10% by weight based on the weight of the starch oxide in such a way that the total amount of the coating layers formed on both sides of the sheet with this coating solution was 2.5 g/m$^2$, and by further applying, to these coating layers, a coating solution containing only a fatty acid sizing agent (main component: palmitic acid; melting point: 63 to 64° C.) cationized with polyamine and modified with epichlorohydrin in such a way that the total amount of the coating layers on both sides with this coating solution was 0.5 g/m$^2$.

Example 10

An oil-resistant sheet material having a basis weight of 45 g/m$^2$ was prepared by manually applying the coating solution prepared in Example 3 (coating solution A) to the paper substrate prepared in Example 1 in such a way that the total amount of the coating layers on both sides was 1.5 g/m$^2$, and by further applying, to these coating layers, a coating solution (coating solution B) containing only a non-modified polyvinyl alcohol having a saponification degree of 93 to 95% and a polymerization degree of 2000 in such a way that the total amount of the coating layers on both sides was 1.5 g/m$^2$.

Example 11

An oil-resistant sheet material having a basis weight of 45 g/m$^2$ was prepared in the same manner as in Example 10 except that, to the coating solution B, polyamide-epichlorohydrin resin was added as a crosslinking agent in a solid content concentration of 10% by weight based on the weight of the polyvinyl alcohol.

Example 12

An oil-resistant sheet material having a basis weight of 45 g/m$^2$ was prepared in the same manner as in Example 10 except that, to the coating solution B, a polyamide-epichlorohydrin resin was added as a crosslinking agent in a solid content concentration of 10% by weight based on the weight of the polyvinyl alcohol, and a fatty acid sizing agent (the main component of the fatty acid: palmitic acid; melting point: 63 to 64° C.) cationized with polyamine and modified with epichlorohydrin was further added in a solid content concentration of 25% by weight based on the weight of the polyvinyl alcohol.

Example 13

An oil-resistant sheet material having a basis weight of 45 g/m$^2$ was prepared by applying, to the paper substrate prepared in Example 1, a coating solution containing only a fatty acid sizing agent (the main component of the fatty acid: palmitic acid; melting point: 63 to 64° C.) cationized with polyamine and modified with epichlorohydrin in such a way that the total amount of the coating layers on both sides was 0.5 g/m$^2$, and by further applying, to these coating layers, the coating solution (coating solution A) prepared in Example 3 in such a way that the total amount of the coating layers on both sides with the coating solution A was 2.5 g/m$^2$.

Example 14

An oil-resistant sheet material having a basis weight of 45 g/m$^2$ was prepared in the same manner as in Example 1 except that a fatty acid (main component: brassidic acid; melting point: 61.5° C.) was used in place of the fatty acid sizing agent cationized with polyamine and modified with epichlorohydrin.

Example 15

An oil-resistant sheet material having a basis weight of 45 g/m$^2$ was prepared in the same manner as in Example 14 except that a fatty acid sizing agent (main component: brassidic acid) cationized with polyamine and modified with epichlorohydrin was used in place of the fatty acid (main component: brassidic acid).

Example 16

An oil-resistant sheet material having a basis weight of 45 g/m$^2$ was prepared in the same manner as in Example 1 except that starch phosphate was used in place of starch oxide.

Example 17

An oil-resistant sheet material having a basis weight of 45 g/m$^2$ was prepared in the same manner as in Example 1 except that starch acetate was used in place of starch oxide.

Example 18

An oil-resistant sheet material having a basis weight of 45 g/m$^2$ was prepared in the same manner as in Example 14 except that a fatty acid sizing agent (main component: stearic acid; melting point: 71.5 to 72° C.) cationized with polyamine and modified with epichlorohydrin was used in place of the fatty acid (main component: brassidic acid).

Example 19

An oil-resistant sheet material having a basis weight of 45 g/m$^2$ was prepared in the same manner as in Example 14 except that a fatty acid sizing agent (main component: lauric acid; melting point: 44° C.) cationized with polyamine and modified with epichlorohydrin was used in place of the fatty acid (main component: brassidic acid).

Example 20

An oil-resistant sheet material having a basis weight of 45 g/m$^2$ was prepared in the same manner as in Example 14 except that stearato-chromic chloride complex was used in place of the fatty acid (main component: brassidic acid).

Comparative Example 1

An oil-resistant sheet material having a basis weight of 45 g/m$^2$ was prepared by applying, to the paper substrate prepared in Example 1, a coating solution containing only starch oxide in such a way that the total amount of the coating layers on both sides was 3.0 g/m$^2$.

Comparative Example 2

An oil-resistant sheet material having a basis weight of 45 g/m$^2$ was prepared by applying, to the substrate prepared in Example 1, a coating solution containing only a carboxyl-modified polyvinyl alcohol having a saponification degree of 93 to 95% and a polymerization degree of 2000 in such a way that the total amount of the coating layers on both sides was 3.0 g/m$^2$.

Comparative Example 3

An oil-resistant sheet material having a basis weight of 45 g/m$^2$ was prepared in the same manner as in Comparative Example 1 except that, to the coating solution, polyamide-epichlorohydrin resin was added as a crosslinking agent in a solid content concentration of 10% by weight based on the weight of the starch oxide.

Comparative Example 4

An oil-resistant sheet material having a basis weight of 67 g/m$^2$ was prepared in the same manner as in Example 1 except that the coating solution was applied in such a way that the total amount of the coating layers on both sides was 25 g/m$^2$.

Comparative Example 5

An oil-resistant sheet material having a basis weight of 42.2 g/m$^2$ was prepared in the same manner as in Example 1 except that the coating solution was applied in such a way that the total amount of the coating layers on both sides was 0.2 g/m$^2$.

Comparative Example 6

An oil-resistant sheet material having a basis weight of 45 g/m$^2$ was prepared by laminating a 4-μm thick polyethylene film on one side of the paper substrate prepared in Example 1.

Table 1 shows the evaluation results of the properties of the oil-resistant sheet materials obtained in above Examples and Comparative Examples. The oil resistance, moisture permeability, hot water resistance, breakage of package and resistance to air permeability were evaluated according to the following methods. The hot water resistance may not be required in some applications of oil-resistant sheets and was accordingly evaluated as reference. Thus, those oil-resistant sheet materials in each of which all of the oil resistance, moisture permeability, breakage of package and resistance to air permeability were evaluated to be at acceptable levels or above were graded as a "pass."

<Evaluation Test of Oil Resistance>

The oil resistance was evaluated as follows: a 0.5-ml drop of castor oil was placed on the surface of an oil-resistant sheet material, a load of 5 g/cm$^2$ was applied to the surface area with the drop of castor oil placed thereon (a metal plate was used for application of load), and the reverse side of the surface area with the drop of castor oil placed thereon was visually observed to measure the time in which the placed drop of castor oil permeated to the reverse side to form approximately the same area as the surface area with the drop of castor oil placed thereon. The maximum measurement time was set at 24 hours and the permeation degree of the placed drop of castor oil to the reverse side was visually observed after predetermined time periods of the above-described treatment. The evaluation criteria of permeation of castor oil were as follows. "Δ" and higher marks were graded as a "pass."

○: Substantially no permeation of castor oil was observed on the reverse side of the surface area with a drop of castor oil placed thereon after 12 hours from placing of the drop of castor oil.

Δ: Permeation of castor oil was observed on the reverse side of the surface area with a drop of castor oil placed thereon between 6 and 12 hours after placing of the drop of castor oil.

X: Permeation of castor oil was observed on the reverse side of the surface area with a drop of castor oil placed thereon within 6 hours after placing of the drop of castor oil.

<Evaluation Test of Moisture Permeability>

In a beaker, 100 ml of boiling water was placed, and a bag-shaped sample of an oil-resistant sheet material was put over the top of the beaker. The beaker was left for 1 hour and dew condensation to the inside of the bag was visually observed. The evaluation criteria of dew condensation were as follows. "Δ" and higher marks were graded as a "pass".

◎: No dew condensation was found inside the bag after leaving for 1 hour.

○: Some degree of dew condensation was found inside the bag after leaving for 1 hour.

Δ: Dew condensation was found all over the inside of the bag after leaving for 1 hour, but no droplet was formed.

X: Dew condensation was found inside the bag after leaving for 1 hour and droplets were formed.

<Evaluation Test of Hot Water Resistance>

The hot water resistance was evaluated by a method in which a sample of an oil-resistant sheet material was cut to a square piece of 5-cm sides and extraction was performed in 100 ml of hot water for 10 minutes, and then the extract solution was evaporated to measure the evaporation residue. The test result was evaluated as follows: a total extract amount of 2 mg/25 cm$^2$ or less was evaluated as "○" and a total extract amount of more than this value was graded as "X."

<Evaluation Test of Breakage of Package>

A bag of an oil-resistant sheet material having a size of 8 cm×14 cm and provided with an opening for putting a sponge on one end thereof was prepared. A sponge having a size of 5 cm×7 cm×4 cm impregnated with 20 ml of water was put in the bag. The opening end of the bag was folded twice and sealed at one central position with scotch tape. The bag was then placed in an electronic oven of an output power of 800 W to be heated for 5 minutes, and whether the bag was broken or not was observed. The evaluation criteria were as follows. "○" was graded as a "pass."

○: Bag was not broken and scotch tape was not peeled off.

X: Bag was broken or scotch tape was peeled off.

<Resistance to Air Permeability>

The resistance to air permeability of each of the oil-resistant sheet materials was measured on the basis of JIS P-8117; the resistance to air permeability of 10000 seconds or less was marked with "○," and the resistance to air permeability exceeding 10000 seconds was marked with "X." "○" was graded as a "pass."

TABLE 1

| | Basis weight ($g/m^2$) | Thickness (mm) | Density ($g/cm^3$) | Oil resistance | Moisture permeability | Hot water resistance | Bag breakage | Resistance to air permeability |
|---|---|---|---|---|---|---|---|---|
| Ex. 1 | 45.1 | 0.069 | 0.65 | Δ | ◎ | Δ | ○ | ○ |
| Ex. 2 | 45.3 | 0.069 | 0.65 | ○ | ○ | Δ | ○ | ○ |
| Ex. 3 | 44.8 | 0.068 | 0.66 | ○ | ◎ | ○ | ○ | ○ |
| Ex. 4 | 45.0 | 0.068 | 0.66 | ○ | ○ | ○ | ○ | ○ |
| Ex. 5 | 45.2 | 0.068 | 0.66 | ○ | ○ | ○ | ○ | ○ |
| Ex. 6 | 45.0 | 0.067 | 0.67 | ○ | ◎ | ○ | ○ | ○ |
| Ex. 7 | 44.9 | 0.067 | 0.67 | Δ | ◎ | Δ | ○ | ○ |
| Ex. 8 | 45.3 | 0.069 | 0.67 | Δ | ○ | Δ | ○ | ○ |
| Ex. 9 | 45.1 | 0.068 | 0.66 | ○ | ◎ | ○ | ○ | ○ |
| Ex. 10 | 44.9 | 0.067 | 0.67 | ○ | Δ | Δ | ○ | ○ |
| Ex. 11 | 45.0 | 0.066 | 0.68 | ○ | Δ | ○ | ○ | ○ |
| Ex. 12 | 44.5 | 0.065 | 0.69 | ○ | ○ | ○ | ○ | ○ |
| Ex. 13 | 44.8 | 0.066 | 0.68 | ○ | ◎ | ○ | ○ | ○ |
| Ex. 14 | 45.0 | 0.067 | 0.67 | Δ | ◎ | Δ | ○ | ○ |
| Ex. 15 | 45.2 | 0.068 | 0.66 | ○ | ◎ | Δ | ○ | ○ |
| Ex. 16 | 44.5 | 0.066 | 0.67 | ○ | ◎ | Δ | ○ | ○ |
| Ex. 17 | 45.3 | 0.069 | 0.67 | ○ | ◎ | Δ | ○ | ○ |
| Ex. 18 | 45.0 | 0.066 | 0.68 | ○ | ◎ | Δ | ○ | ○ |
| Ex. 19 | 44.8 | 0.066 | 0.68 | ○ | ◎ | Δ | ○ | ○ |
| Ex. 20 | 45.1 | 0.068 | 0.66 | ○ | ◎ | Δ | ○ | ○ |
| Com. Ex. 1 | 45.1 | 0.066 | 0.68 | X | Δ | X | ○ | ○ |
| Com. Ex. 2 | 45.0 | 0.067 | 0.67 | X | X | X | X | X |
| Com. Ex. 3 | 45.3 | 0.069 | 0.67 | X | Δ | ○ | ○ | ○ |
| Com. Ex. 4 | 67.2 | 0.100 | 0.67 | ○ | X | Δ | X | X |
| Com. Ex. 5 | 42.2 | 0.064 | 0.67 | X | ◎ | Δ | ○ | ○ |
| Com. Ex. 6 | 45.2 | 0.068 | 0.66 | ○ | X | ○ | X | X |

As can be seen from the results shown in Table 1, each of the oil-resistant materials of Examples 1 to 20 of the present invention has low resistance to air permeability, and is harmless to humans and excellent in oil resistance and in productivity.

INDUSTRIAL APPLICABILITY

The oil-resistant sheet material according to the present invention is excellent in oil resistance and grease resistance, and can be suitably used as a packaging material for food containing edible oil such as breaded fried food, deep-fried food and the like.

The invention claimed is:

1. An oil-resistant sheet material having at least one coating layer containing starch and/or polyvinyl alcohol and a fatty acid formed on at least one side of a substrate in a solid content of 0.5 to 20 $g/m^2$, wherein the fatty acid is a fatty acid sizing agent, modified with epichlorohydrin.

2. The oil-resistant sheet material according to claim 1, wherein the coating layer further contains a crosslinking agent.

3. The oil-resistant sheet material according to claim 1, wherein at least one coating layer containing polyvinyl alcohol as a main component is further formed.

4. The oil-resistant sheet material according to claim 1, wherein at least one coating layer containing a fatty acid as a main component is further formed.

5. An oil-resistant sheet material wherein at least two coating layers comprising the coating layer as defined in claim 1 disposed closer to the substrate and a coating layer containing a fatty acid as a main component disposed farther from the substrate are formed on at least one side of the substrate.

6. The oil-resistant sheet material according to claim 2, wherein the crosslinking agent is an epichlorohydrin crosslinking agent.

7. The oil-resistant sheet material according to claim 1, which has a resistance to air permeability specified in JIS P-8117 of 10000 seconds or less.

8. A packaging material for food, which comprises an oil-resistant sheet material having at least one coating layer containing starch and/or polyvinyl alcohol and a fatty acid formed on at least one side of a substrate in a solid content of 0.5 to 20 $g/m^2$, wherein the fatty acid is a fatty acid sizing agent, modified with epichlorohydrin.

9. A package formed of the packaging material of claim 8.

* * * * *